US009840259B2

(12) United States Patent
Simpson et al.

(10) Patent No.: US 9,840,259 B2
(45) Date of Patent: Dec. 12, 2017

(54) RAILWAY CAR WINDOW ASSEMBLIES AND ASSEMBLY METHODS

(71) Applicant: FAIVELEY TRANSPORT NORTH AMERICA, INC., Greenville, SC (US)

(72) Inventors: Daniel Wayne Simpson, Easley, SC (US); Robert Wayne Lewis, Jr., Duncan, SC (US)

(73) Assignee: FAIVELEY TRANSPORT NORTH AMERICA, INC., Greenville, SC (US)

( * ) Notice: Subject to any disclaimer, the term of this patent is extended or adjusted under 35 U.S.C. 154(b) by 70 days.

(21) Appl. No.: 14/697,919

(22) Filed: Apr. 28, 2015

(65) Prior Publication Data

US 2016/0319586 A1 Nov. 3, 2016

(51) Int. Cl.

| | |
|---|---|
| ***E06B 3/04*** | (2006.01) |
| ***B61D 25/00*** | (2006.01) |
| ***B61D 17/00*** | (2006.01) |

(52) U.S. Cl.

CPC ..... *B61D 17/00* (2013.01); *B61D 25/00* (2013.01)

(58) Field of Classification Search

CPC ..... E06B 1/18; E06B 1/40; E06B 3/26; E06B 3/549; E06B 2003/5472; B61D 17/00; B61D 19/02; B61D 25/00

See application file for complete search history.

(56) References Cited

U.S. PATENT DOCUMENTS

| | | | | | |
|---|---|---|---|---|---|
| 2,105,180 | A * | 1/1938 | Blessin | B61D 25/00 | 29/450 |
| 2,443,548 | A * | 6/1948 | Wilson | E04B 2/822 | 52/126.3 |
| 3,699,734 | A * | 10/1972 | Craig | E04B 2/82 | 52/127.6 |
| 4,502,260 | A * | 3/1985 | Machler | A47G 1/10 | 160/369 |
| 4,850,141 | A * | 7/1989 | Pacca | E06B 3/28 | 49/380 |
| 4,920,718 | A * | 5/1990 | Artwick | E06B 3/549 | 52/204.591 |

(Continued)

FOREIGN PATENT DOCUMENTS

| | | | | |
|---|---|---|---|---|
| DE | 800053 C | * | 8/1950 | B61D 25/00 |
| DE | 2536824 A1 | * | 3/1977 | E06B 3/08 |

(Continued)

*Primary Examiner* — Christine T Cajilig
(74) *Attorney, Agent, or Firm* — Dority & Manning, P.A.

(57) ABSTRACT

Window assemblies and methods for assembling window assemblies for railway cars are provided. A window assembly includes a first frame portion, which defines a first frame side, a portion of a third frame side, and a portion of a fourth frame side, and which includes a first body which defines a first outer channel. The window assembly further includes a second frame portion which defines a second frame side, a portion of the third frame side, and a portion of the fourth frame side, and which includes a second body which defines a second outer channel. The window assembly further includes a first wear bar at least partially disposed within the first outer channel, and a second wear bar at least partially disposed and resiliently adjustable within the second outer channel. The first frame portion and the second frame portion together define a frame aperture therebetween.

16 Claims, 6 Drawing Sheets

(56) References Cited

U.S. PATENT DOCUMENTS

| | | | | | |
|---|---|---|---|---|---|
| 5,216,856 | A | * | 6/1993 | Schroeder | E06B 1/6084<br>49/504 |
| 5,806,256 | A | * | 9/1998 | Byrne | E06B 3/08<br>52/204.5 |
| 5,893,600 | A | * | 4/1999 | McManus | B60J 1/001<br>296/146.16 |

FOREIGN PATENT DOCUMENTS

| | | | | | |
|---|---|---|---|---|---|
| FR | 613485 | A | * | 11/1926 | B61D 25/00 |
| FR | 1160182 | A | * | 7/1958 | B60J 1/001 |
| GB | 317674 | A | * | 8/1929 | B61D 25/00 |

* cited by examiner

RAILWAY CAR WINDOW ASSEMBLIES AND ASSEMBLY METHODS

FIELD OF THE INVENTION

The present invention relates generally to window assemblies for railroad cars, and in particular to efficiently assembled and dis-assembled frames for such window assemblies.

BACKGROUND OF THE INVENTION

Trains which include one or more railway cars are widely used for transportation of goods and passengers throughout the United States and abroad. A typical train includes a plurality of railways cars which are connected together for travel. Each car includes a plurality of specially designed wheels for traveling along a vast infrastructure of railway tracks.

Many railway cars, including passenger cars, locomotive cars, caboose cars, etc., include windows. Windows can be included in the body of the car and/or the door of the car, and may generally allow passengers and/or the operator in the railway cars to see outside of the cars.

One particular disadvantage of currently known window designs, however, is the difficulty of installation and removal of the window for, for example, maintenance or replacement work. To remove a presently known window, the entire main frame assembly in which the window is installed must be removed from the railway car body. Molding, wiring, interior materials, and other components of the main frame assembly must then be removed in order to access and remove the window. The process of removing and replacing a window in a railcar is thus extremely inefficient, potentially requiring the railway car to be out of service for on the order of 3 days or longer.

Accordingly, improved window designs and methods for assembling (and removing) windows of railway cars are desired. In particular, window designs and methods that facilitate efficient and cost-effective removal and replacement would be advantageous.

BRIEF DESCRIPTION OF THE INVENTION

Aspects and advantages of the invention are set forth below in the following description, or may be obvious from the description, or may be learned through practice of the invention.

In accordance with one embodiment of the present disclosure, a window assembly for a railway ear is provided. The window assembly includes a first frame portion, the first frame portion defining a first frame side, a portion of a third frame side, and a portion of a fourth frame side, the first frame portion including a first body which defines a first outer channel. The window assembly further includes a second frame portion, the second frame portion defining a second frame side, a portion of the third frame side, and a portion of the fourth frame side, the second frame portion including a second body which defines a second outer channel. The window assembly further includes a first wear bar at least partially disposed within the first outer channel, and a second wear bar at least partially disposed and resiliently adjustable within the second outer channel. The first frame portion and the second frame portion together define a frame aperture therebetween.

In accordance with another embodiment of the present disclosure, a door for a railway car is provided. The door includes a door body, a window aperture defined in the door body, and a window assembly disposed within the window aperture. The window assembly includes a first frame portion, the first frame portion defining a first frame side, a portion of a third frame side, and a portion of a fourth frame side, the first frame portion including a first body which defines a first outer channel. The window assembly further includes a second frame portion, the second frame portion defining a second frame side, a portion of the third frame side, and a portion of the fourth frame side, the second frame portion including a second body which defines a second outer channel. The window assembly further includes a first wear bar at least partially disposed within the first outer channel, and a second wear bar at least partially disposed and resiliently adjustable within the second outer channel. The first frame portion and the second frame portion together define a frame aperture therebetween.

In accordance with another embodiment of the present disclosure, a method for assembling a railway car window assembly is provided. The method includes connecting a first frame portion and a second frame portion to form a frame which defines a frame aperture. The first frame portion defines a first frame side, a portion of a third frame side, and a portion of a fourth frame side. The second frame portion defines a second frame side, a portion of the third frame side, and a portion of the fourth frame side. The method further includes inserting a window glazing within the frame aperture.

Those of skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
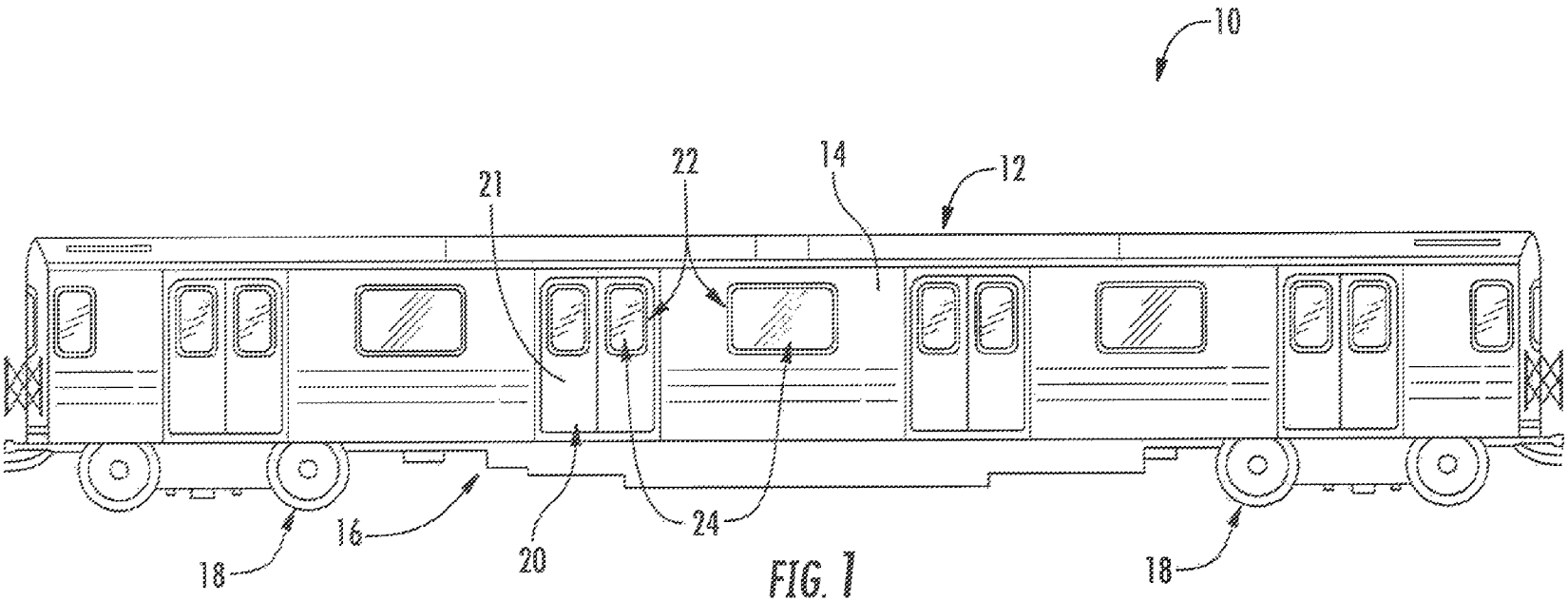
FIG. 1 is side view of a railway car in accordance with one embodiment of the present disclosure.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", "third" and "fourth" may be used interchangeably to distinguish one component from another and are not intended to signify location or importance of the individual components.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Referring now to the figures, FIG. 1 provides a train 10, and specifically a railway car 12 of the train 10, in accordance with one embodiment of the present disclosure. Train 10 may include any number of railway cars 12, and the cars 12 may be linked together to form the train 10 as is generally understood. Any suitable trains, including for example, long-distance trains, short-distance trains, commuter trains (such as subway trains), high-speed trains, monorail trains, etc., and utilized for passengers, freight, both, etc., are within the scope and spirit of the present disclosure. Further, a railway car 12 may be any suitable car within a train 10, such as a locomotive, passenger car, freight car, caboose, etc.

Car 12 may generally include a body 14 and a rail chassis 16 on which the body 14 is disposed. Chassis 16 may include various components for facilitating movement of the car 12 on one or more railway tracks, such as wheels 18, as is generally understood. Further, in some embodiments, one or more doors 20 may be included. The doors 20 may slide or rotate to allow the entrance and exit of passengers, freight, etc. Additionally, one or more window apertures 22 may be defined in car 12, such as in the body 14 and/or the door body 21 of a door 20. Further, a window assembly 24 may be disposed within each window aperture 22 to, for example, allow a passenger to view exterior to the train 10 from inside the car 12.

Referring now to FIGS. 2 through 6, embodiments of window assemblies 24 in accordance with the present disclosure are provided. Window assemblies 24 in accordance with the present disclosure are advantageously efficient and cost-effective to assemble and dis-assemble, and thus install and remove in a railway car 12. For example, removal and replacement of a window assembly 24 in accordance with the present disclosure can in some cases be performed in a matter of hours, rather than days. Additionally, removal of the main frame assembly in which the window assembly 24 is installed, such as of the door 20 or body 14, is advantageously not required.

As shown, window assembly 24 may advantageously include a first frame portion 32 and a second frame portion 34 which together may form a frame 30 and define a frame aperture 31 therebetween. First frame portion 32 includes a body 36 which may include various sections of the frame, and second frame portion 34 includes a body 38 which may include various other sections of the frame. For example, first frame portion 32 may include a first frame side 42, a portion of a third frame side 46, and a portion of a fourth frame side 48. Second frame portion 34 may include a second frame side 44, a portion of the third frame side 46, and a portion of the fourth frame side 48. The frame 30 and frame sides thereof may generally have a rectangular or rounded rectangular shape, with the first and second frame sides 42, 44 spaced apart (such as along a vertical axis V) and generally parallel and the third and fourth frame sides 46, 48 spaced apart (such as along a lateral axis L) and generally parallel. First frame side 42 may for example be a left side or a right side, and second frame side 44 may for example, be the other of the left side or right side. Third frame side 46 may be a top side, and fourth frame side 48 may be a bottom side.

Notably, the coordinate system which includes vertical axis V and lateral axis L additionally includes transverse axis T, and these axes V, L, T are mutually orthogonal.

As further illustrated, first frame portion 32 may include a first outer channel 52 which is defined in the body 36 of the first frame portion 32, such as in an outer peripheral edge of the body 36. The channel 52 may extend peripherally through the entire body 36 (including the entire first, third and fourth sides 42, 46, 48) or a portion thereof. Second frame portion 34 may include a second outer channel 54 which is defined in the body 38 of the second frame portion 34, such as in an outer peripheral edge of the body 38. The channel 54 may extend peripherally through the entire body 38 (including the entire second, third and fourth sides 44, 46, 48) or a portion thereof.

As discussed, the frame portions 32, 34 generally define a frame aperture 31. This frame aperture 31 may accommodate one or more window glazings 60 therein. As shown, for example, a window glazing 60 may be disposed between the first frame portion 32 and the second frame portion 34 within the frame aperture 31. Window glazing 60 may be formed from a suitable material such glass or plastic, and in exemplary embodiments is transparent or translucent. Window glazing 60 may, when assembled within frame 30, contact an inner peripheral edge or portions thereof of the bodies 36, 38.

To facilitate mounting, assembly, and adjustment of the window assembly 24 within window aperture 22, window assembly 24 may include various additional components which may interact with the frame portions 32, 34. For example, window assembly 24 may include a first wear bar 70 and a second wear bar 72. The first wear bar 70 may be at least partially disposed within the first outer channel 52, such on the first frame side 42, while the second wear bar 72 is at least partially disposed within the second outer channel 54, such as on the second frame side 44. The wear bars 70, 72 may generally contact surfaces defining the window aperture 22 when the window assembly 24 is assembled within the window aperture 22, and may facilitate a proper fit of the window assembly 24 within the window aperture 22.

In some embodiments, wear bar 70 may, for example, be connected to the first body 36. For example, one or more suitable mechanical fasteners 71, such screws (as shown), rivets, nails, nut/bolt combinations, etc., may be utilized to connect the wear bar 70 and first body 36 together. Alternatively, wear bar 70 may be welded, brazed, bonded or otherwise affixed to first body 36.

Wear bar 72, on the other hand, may in some embodiments be resiliently adjustable within the second channel 54, and thus may not be connected to the second body 38. Accordingly, wear bar 72 may be movable relative to second channel 54. For example, second wear bar 72 may be resiliently adjustable along lateral axis L. In exemplary embodiments as shown, one or more biasing members 73 may facilitate the resilient adjustability of the wear bar 72. Biasing members 73 may be, for example, spring plungers (as shown), springs, or other suitable devices which provide a biasing force to an associated component. Each biasing member 73 may be disposed at least partially within the second outer channel 54, such as between wear bar 72 and body 38. In embodiments wherein spring plungers are utilized, for example, the spring plungers may be screwed into the second body 38 and may extend into the second channel 54, and wear bar 72 may contact the spring plungers.

The resilient adjustability of the wear bar 72 advantageously allows for the window assembly 24 to be fit within window apertures 22 having varying sizes, without the requirement for exceedingly tight tolerances on the window aperture 22 sizes. During assembly of a window assembly 24 within a window aperture 22, the resilient adjustability of the wear bar 72 may allow for contact between a surface defining the window aperture 22 and the wear bar 72 despite variations in the window aperture 22 size.

In exemplary embodiments, wear bars 70, 72 are formed from a suitable polymer such as polyoxymethylene. In other embodiments, wear bars 70, 72 may be formed from other suitable materials such as metals, etc.

It should be understood that in alternative embodiments, either or both of wear bars 70, 72 may be connected to the respective bodies 36, 38 or resiliently adjustable within their respective outer channels 52, 54.

Window assembly 24 may further include a guide bar 80. Guide bar 80 may facilitate alignment and connection of the frame portions 32, 34 during assembly of the window assembly 24. As shown, when assembled, guide bar 80 may be disposed partially within first channel 52 and partially within second channel 54, such as on the fourth frame side 48. The guide bar 80 may further be connected to the first body 36 and second body 38. For example, suitable mechanical fasteners 81 (such as screws as shown) may be utilized to connect the guide bar 80 to the first body 36 and/or second body 38, and/or the guide bar 80 may be affixed to the first body 36 and/or second body 38. In the embodiment shown, for example, guide bar 80 is affixed to the second body 38, and mechanical fasteners 81 are utilized to connect the guide bar 80 to the first body 36.

Additional components may be utilized to further align and connect the frame portions 32, 34 during assembly of the window assembly 24. For example, referring now to FIG. 6, in some embodiments, window assembly 24 may include a coupling member 90. Coupling member 90 may, when assembled, be disposed at least partially within first channel 52 or an auxiliary channel 92 extending therefrom into body 36, and disposed at least partially within second channel 54 or an auxiliary channel 94 extending therefrom into body 38, such as on the third frame side 46. The coupling member 90 may further be connected to the first body 36 and second body 38. For example, suitable mechanical fasteners 91 (such as screws as shown) may be utilized to connect the coupling member 90 to the first body 36 and/or second body 38, and/or the coupling member 90 may be affixed to the first body 36 and/or second body 38. In the embodiment shown, for example, mechanical fasteners 91 are utilized to connect the coupling member 90 to the first body 36 and second body 38.

Figure 2:
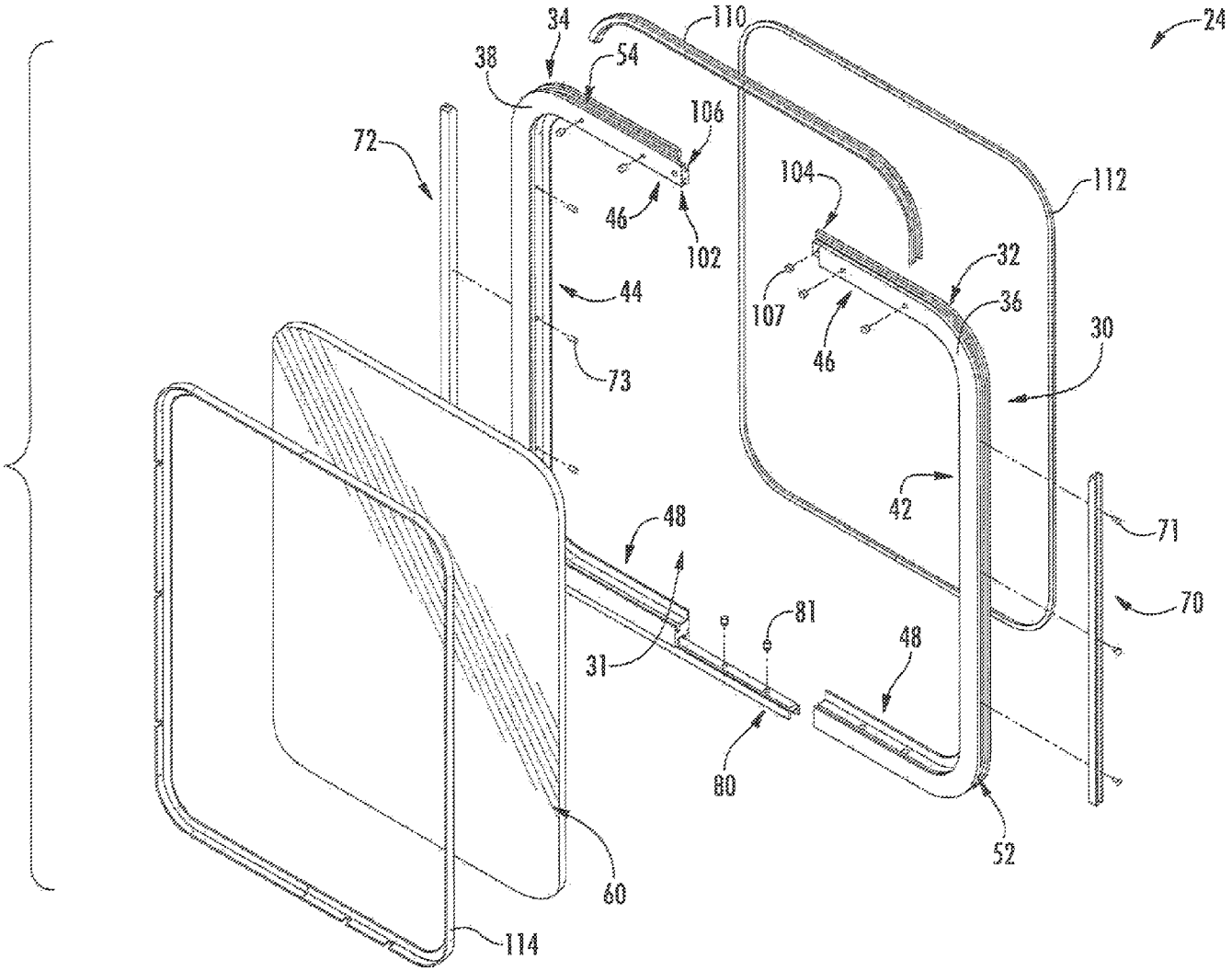
FIG. 2 is a perspective exploded view of a window assembly for a railway car in accordance with one embodiment of the present disclosure.
Figure 3:
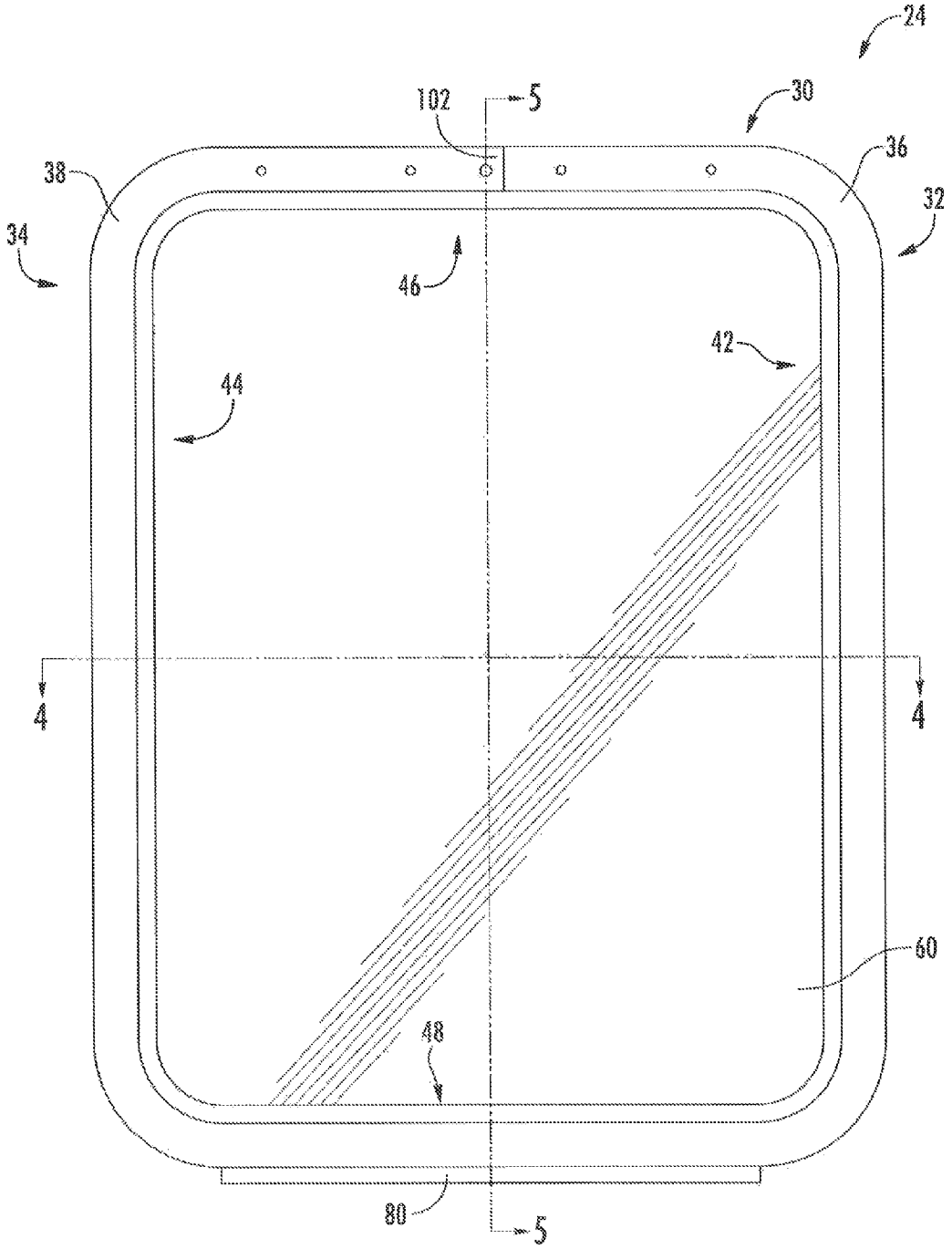
FIG. 3 is a front view of a window assembly for a railway car in accordance with one embodiment of the present disclosure.
Figure 4:
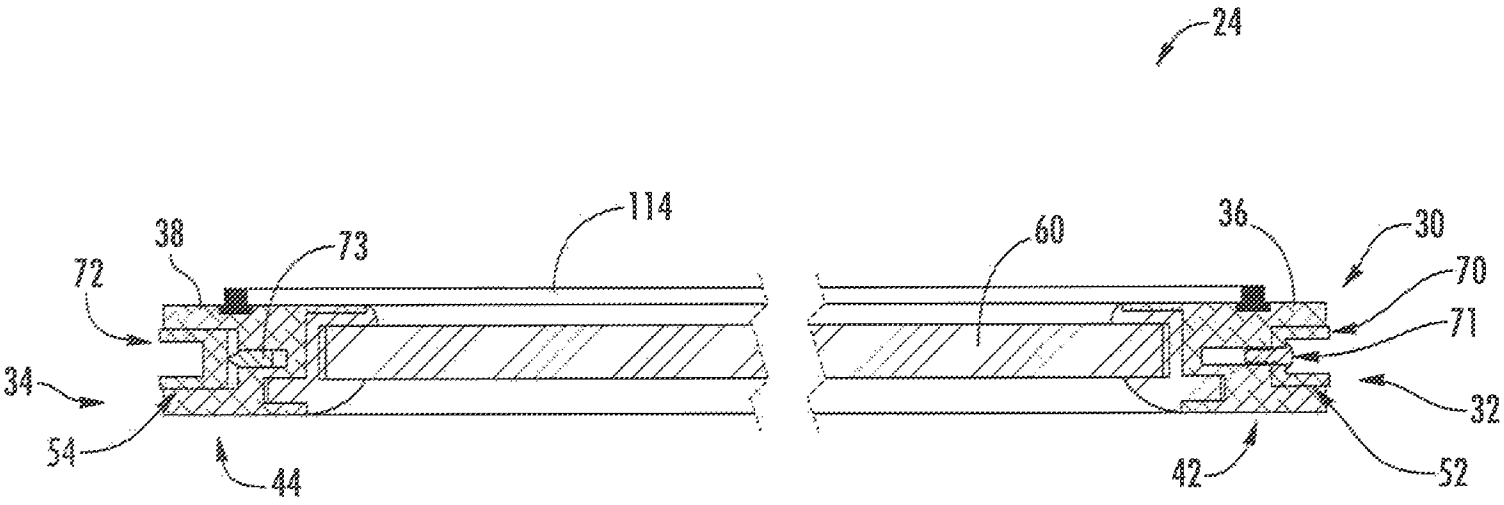
FIG. 4 is a cross-sectional view, along the lines 4-4 of FIG. 3, of a window assembly for a railway car in accordance with one embodiment of the present disclosure.
Figure 5:
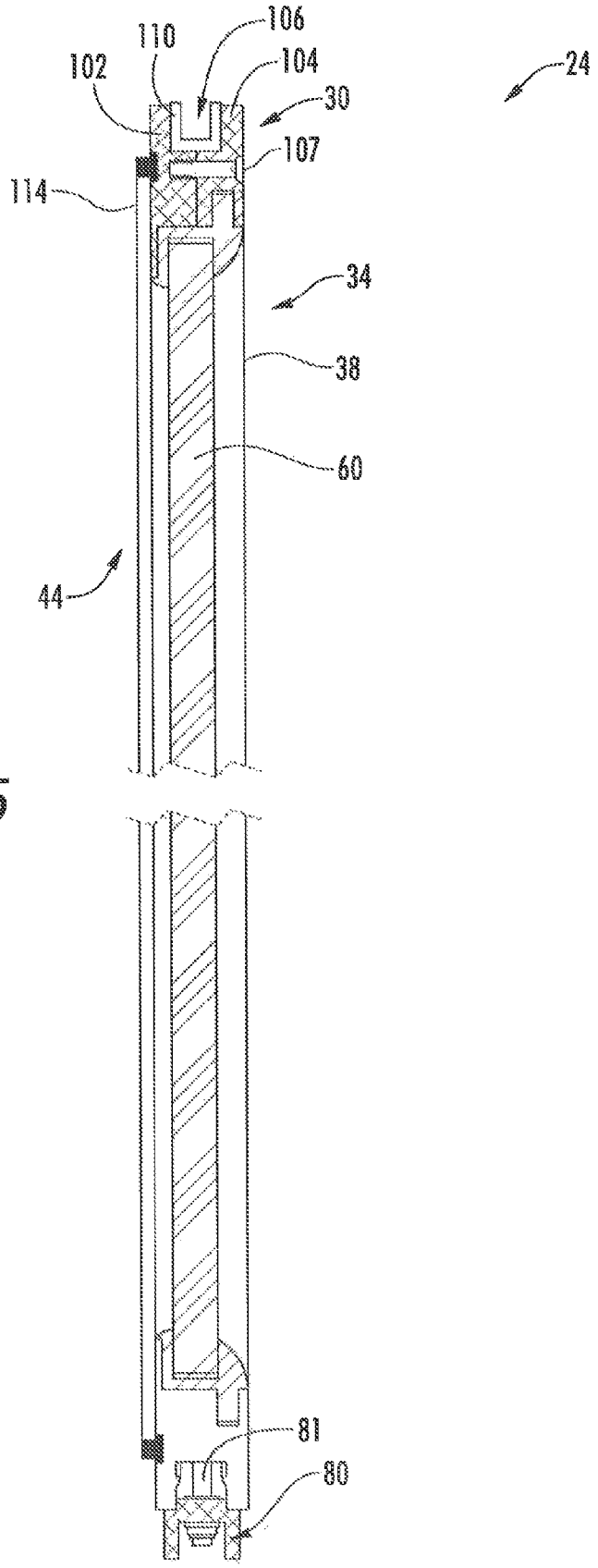
FIG. 5 is a cross-sectional view, along the lines 5-5 of FIG. 3, of a window assembly for a railway car in accordance with one embodiment of the present disclosure.
Figure 6:
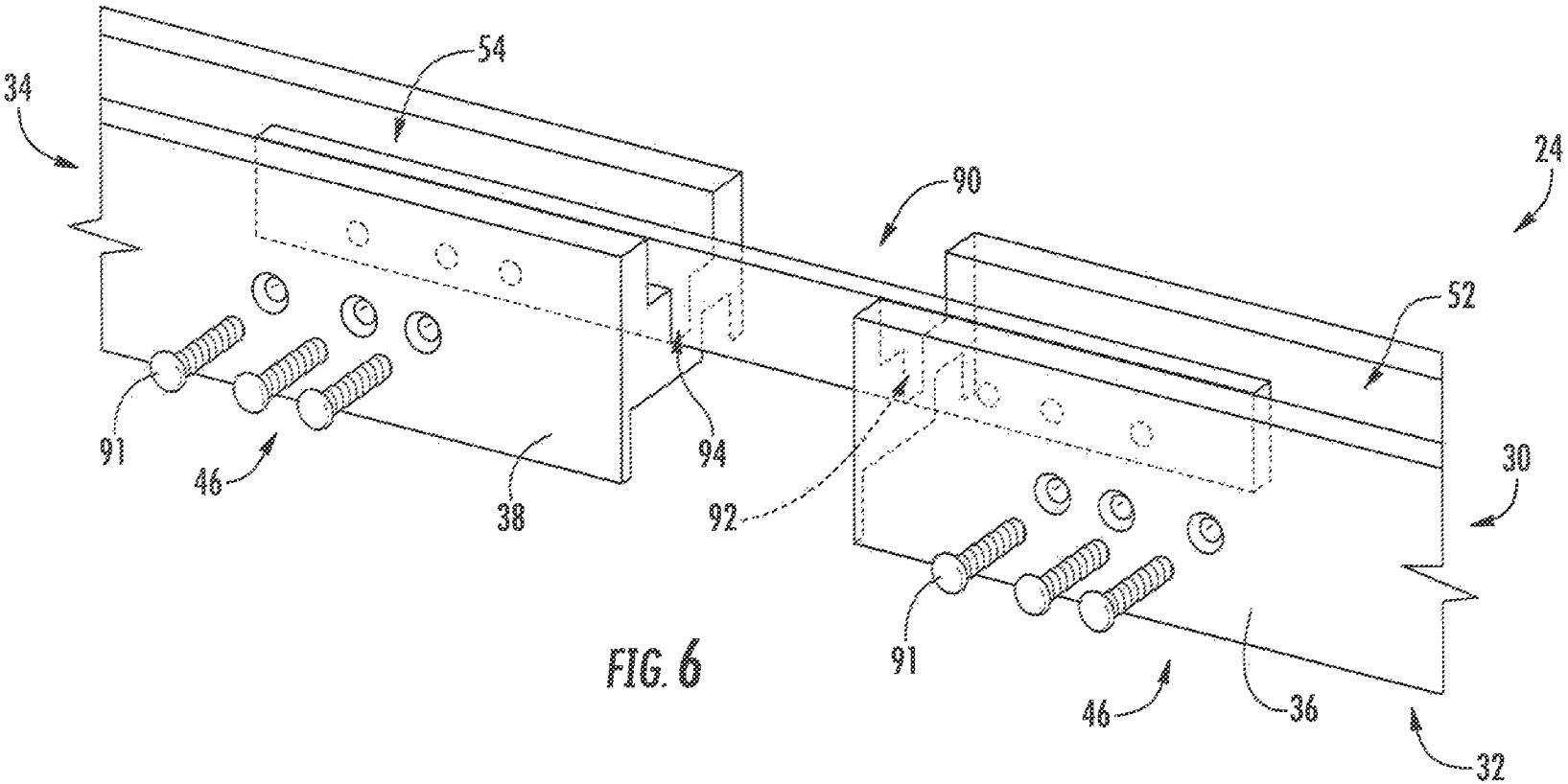
FIG. 6 is a perspective view of a portion of a window assembly for a railway car being assembled in accordance with one embodiment of the present disclosure.

In other embodiments, as shown in FIG. 2, first body 36 may include one of an overhang portion 102 (as shown) or undercut portion (not shown), and second body 38 may include the other of an overhang portion (not shown) or undercut portion 104. The overhang portion 102 and undercut portion 104 may, for example, extend from the respective third frame sides 46. Overhang portion 102 and undercut portion 104 may together define an outer channel 106 therebetween, which may when assembled be considered to be part of first outer channel 52, second outer channel 54, or a channel between the first and second outer channels 52, 54. The overhang portion 102 and undercut portion 104 may be connected together when the window assembly 24 is assembled, to facilitate alignment and connection of the first frame portion 32 and second frame portion 34. For example, suitable mechanical fasteners 107 (such as screws as shown) may be utilized to connect the overhang portion 102 and undercut portion 104, and/or the overhang portion 102 and undercut portion 104 may be affixed together.

Window assembly 24 may further include additional components for facilitating use of the window assembly 24 in a railway car. For example, channel weather stripping 110 may be disposed at least partially within at least portions of channels 52, 54, such as at least on the third and fourth frame sides 46, 48. Exterior weather stripping 112 may additionally be included, which may extend around a side surface of the bodies 36, 38. Weather stripping 110 and 112 may, for example, be formed from neoprene. An outer glazing 114 may additionally be included, which may extend around an opposing side surface of the bodies 36, 38. Outer glazing 114 may additionally, for example, be formed from neoprene.

The present disclosure is further directed to methods for assembling window assemblies 24, such as within window apertures 22 of railway cars 12. A method may include, for example, the step of connecting first frame portion 32 and second frame portion 34 together to form a frame 30 which defines a frame aperture 31, as discussed herein. Method may further include for example, inserting one or more window glazings 60 within the frame aperture 31, as discussed herein. Insertion of window glazings 60 may occur, for example, before, during, or after connecting the first frame portion 32 and second frame portion 34 together.

In some embodiments, a method in accordance with the present disclosure may further include the step of connecting or otherwise disposing first wear bar 70 at least partially within first outer channel 52, as discussed herein. Additionally, in some embodiments, a method in accordance with the present disclosure may further include the step of positioning or otherwise disposing second wear bar 72 at least partially within second outer channel 54, as discussed herein. Further, in some embodiments, a method in accordance with the present disclosure may include the step of inserting a biasing member 73 at least partially within the second outer channel 74, as discussed herein.

The connecting step may include, for example, the step of inserting a guide bar 80 at least partially within first channel 52 and/or partially within second channel 54, such as on the fourth frame side 48, as discussed herein. Further, guide bar 80 may be coupled to body 36 and body 38, such as via a connection and/or affixation as discussed herein.

The connecting step may additionally or alternatively include, for example, the step of inserting a coupling member 90 at least partially into a channel defined in the first body 36 and/or at least partially into a channel defined in the second body 38, such as on the third frame side 46, as discussed herein. For example, the channels could be first and second channels 52, 54 or auxiliary channels 92, 94. Further, coupling member 90 may be coupled to body 36 and body 38, such as via a connection and/or affixation as discussed herein. Alternatively, the connecting step may additionally or alternatively include, for example, overlapping an overhang portion 102 and an undercut portion 104, as discussed herein. Further, overhang portion 102 and undercut portion 104 may be coupled together, such as via a connection and/or affixation as discussed herein.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A window assembly for a railway car, the window assembly comprising:

a first frame portion, the first frame portion defining a first frame side, a portion of a third frame side, and a portion of a fourth frame side, the first frame portion comprising a first body which defines a first outer channel;

a second frame portion, the second frame portion defining a second frame side, a portion of the third frame side, and a portion of the fourth frame side, the second frame portion comprising a second body which defines a second outer channel;

a first wear bar at least partially disposed within the first outer channel;

a second wear bar at least partially disposed and resiliently adjustable within the second outer channel; and a biasing member located only in the second frame portion, the biasing member extending into the second frame portion and partially disposed within the second outer channel, the biasing member in contact with the second wear bar and adjustable to resiliently adjust the second wear bar, wherein the first frame portion and the second frame portion together define a frame aperture therebetween and the first frame side, second frame side, third frame side, and fourth frame side together define an entire outer periphery of the window assembly.

2. The window assembly of claim 1, further comprising a window glazing disposed between the first frame portion and the second frame portion within the frame aperture.

3. The window assembly of claim 1, wherein the first wear bar is connected to the first body.

4. The window assembly of claim 1, wherein the first wear bar is at least partially disposed within the first outer channel on the first frame side and the second wear bar is at least partially disposed within the second outer channel on the second frame side.

5. The window assembly of claim 1, wherein the second wear bar is resiliently adjustable along a lateral axis.

6. The window assembly of claim 1, wherein the biasing member is a spring plunger.

7. The window assembly of claim 1, further comprising a guide bar disposed partially within the first channel and partially within the second channel.

8. The window assembly of claim 7, wherein the guide bar is disposed partially within the first channel and partially within the second channel on the fourth frame side.

9. The window assembly of claim 1, further comprising a coupling member disposed partially within an auxiliary channel extending from the first channel into the first body and an auxiliary channel extending from the second channel into the second body on the third frame side.

10. The window assembly of claim 1, wherein the first body comprises one of an overhang portion or an undercut portion extending from the third frame side and the second body comprises the other of the overhang portion or the undercut portion extending from the third frame side.

11. The window assembly of claim 1, wherein the first frame side is one of a left side or a right side, the second frame side is the other of the left side or the right side, the third frame side is a top side, and the fourth frame side is a bottom side.

12. A door for a railway car, the door comprising:

a door body;

a window aperture defined in the door body; and a window assembly disposed within the window aperture, the window assembly comprising:

a first frame portion, the first frame portion defining a first frame side, a portion of a third frame side, and a portion of a fourth frame side, the first frame portion comprising a first body which defines a first outer channel;

a second frame portion, the second frame portion defining a second frame side, a portion of the third frame side, and a portion of the fourth frame side, the second frame portion comprising a second body which defines a second outer channel;

a first wear bar at least partially disposed within the first outer channel;

a second wear bar at least partially disposed and resiliently adjustable within the second outer channel; and a biasing member located only in the second frame portion, the biasing member extending into the second frame portion and partially disposed within the second outer channel, the biasing member in contact with the second wear bar and adjustable to resiliently adjust the second wear bar, wherein the first frame portion and the second frame portion together define a frame aperture therebetween and the first frame side, second frame side, third frame side, and fourth frame side together define an entire outer periphery of the window assembly.

13. A method for assembling a railway car window assembly, the method comprising:

connecting a first frame portion and a second frame portion to form a frame which defines a frame aperture, the first frame portion defining a first frame side, a portion of a third frame side, and a portion of a fourth frame side, the second frame portion defining a second frame side, a portion of the third frame side, and a portion of the fourth frame side, wherein the first frame side, second frame side, third frame side, and fourth frame side together define an entire outer periphery of the window assembly;

inserting a window glazing within the frame aperture;

connecting a first wear bar at least partially within a first outer channel defined in a first body of the first frame portion;

positioning a second wear bar at least partially within a second outer channel defined in a second body of the second frame portion, wherein the second wear bar is resiliently adjustable within the second outer channel; and inserting a biasing member into the second frame portion and partially within the second outer channel, the biasing member located only in the second frame portion, the biasing member in contact with the second wear bar and adjustable to resiliently adjust the second wear bar.

14. The method of claim 13, wherein the connecting step comprises inserting a coupling member into a channel defined in the first body and a channel defined in the second body on the third side.

15. The method of claim 14, wherein the channel defined in the first body is an auxiliary channel extending from a first channel into the first body and the channel defined in the second body is an auxiliary channel extending from a second channel into the second body.

16. The method of claim 13, wherein the connecting step comprises overlapping an overhang portion extending from the third frame side of one of the first frame body or the second frame body and an undercut portion extending from the third frame side of the other of the first frame body or the second frame body.

* * * * *